United States Patent [19]

Smith-Vaniz

[11] 4,148,481

[45] Apr. 10, 1979

[54] ACOUSTIC BOWLING PIN DETECTION SYSTEM

[75] Inventor: W. R. Smith-Vaniz, Fairfield, Conn.

[73] Assignee: AMF Incorporated, White Plains, N.Y.

[21] Appl. No.: 812,359

[22] Filed: Jul. 1, 1977

[51] Int. Cl.[2] ..... A63D 5/04

[52] U.S. Cl. ..... 273/54 E; 235/92 GA; 273/54 C; 364/411

[58] Field of Search ..... 181/125; 235/92 GA; 273/46, 50, 52, 53, 54 R, 54 C, 54 E, 102.1 R, 102.1 C, 102.2 R, 102.2 B, 102.2 S; 340/1 R, 16; 364/410, 411, 514, 200, 900

[56] References Cited

U.S. PATENT DOCUMENTS

| | | | |
|---|---|---|---|
| 3,099,447 | 7/1963 | Isenberg et al. | 273/52 |
| 3,140,872 | 7/1964 | Bolger | 273/54 E |
| 3,172,075 | 3/1965 | Kay | 340/1 R |
| 3,237,150 | 2/1966 | Beck et al. | 340/1 R |
| 3,651,328 | 3/1972 | Hutto et al. | 273/54 E X |
| 3,795,402 | 3/1974 | Bolger et al. | 273/54 E |
| 3,907,290 | 9/1975 | Fischer et al. | 273/54 C |
| 3,962,699 | 6/1976 | Brunson | 273/54 E X |
| 4,012,588 | 3/1977 | Davis et al. | 340/16 R X |
| 4,016,528 | 4/1977 | Takeuchi | 340/1 R |
| 4,023,135 | 5/1977 | Hanmura et al. | 340/1 R |
| 4,050,056 | 9/1977 | Massa | 340/1 |
| 4,079,352 | 3/1978 | Burckhardt et al. | 340/1 R |

*Primary Examiner*—Vance Y. Hum

*Attorney, Agent, or Firm*—George W. Price; John H. Gallagher

[57] ABSTRACT

An acoustic pin detecting and locating device is disclosed, comprising a linear array of transducers mounted on each kickback wall. A microprocessor sequentially energizes each transducer with a short burst of high frequency pulses; the reflections from standing pins to the transmitting transducer (direct data) and the next adjacent transducer (cross data) are gated into separate a/d converters. The converters are sampled periodically to divide the signal return to each transducer into a plurality of range cells. The direct data and cross data returns to each transducer array form two data fields. Analysis of these fields provides the information needed for detection of the location of each standing pin. The system electronics include a specially designed transducer selection system including a shift register for selecting only one transducer at a time to transmit acoustic energy, and simultaneously enable one or more gates connected to the transmitting transducer and the next adjacent transducer to transfer analog signal representations of the echo signals to the a/d converters. Each a/d converter incorporates a threshold comparator, specially designed so that the threshold is logarithmically increased each time the magnitude of the echo signal return exceeds the threshold, up to a defined maximum. Each time the converter output count is sampled, the threshold is reset to its base level.

18 Claims, 13 Drawing Figures

10
30
P11
P12
P14
P17
T1
T2
T3
T4
T5
T6
T7
32
2
2

40
34
38
T5
42
41
30
36
32
41
42

FIG. 4
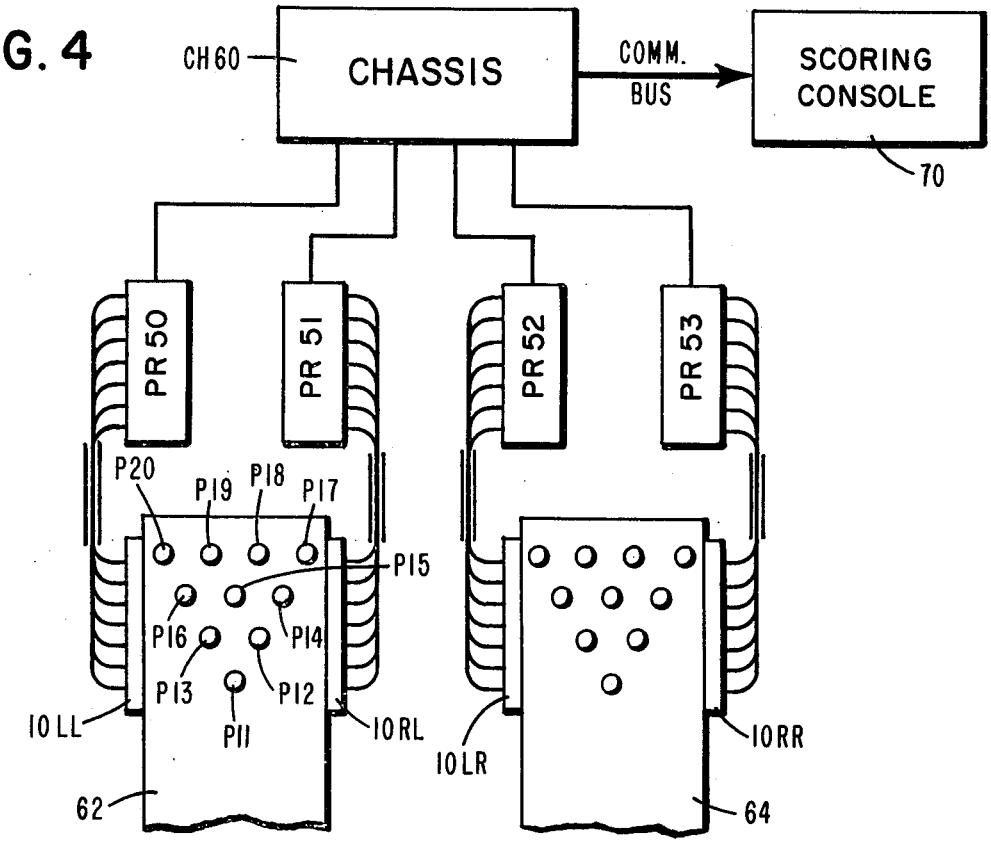
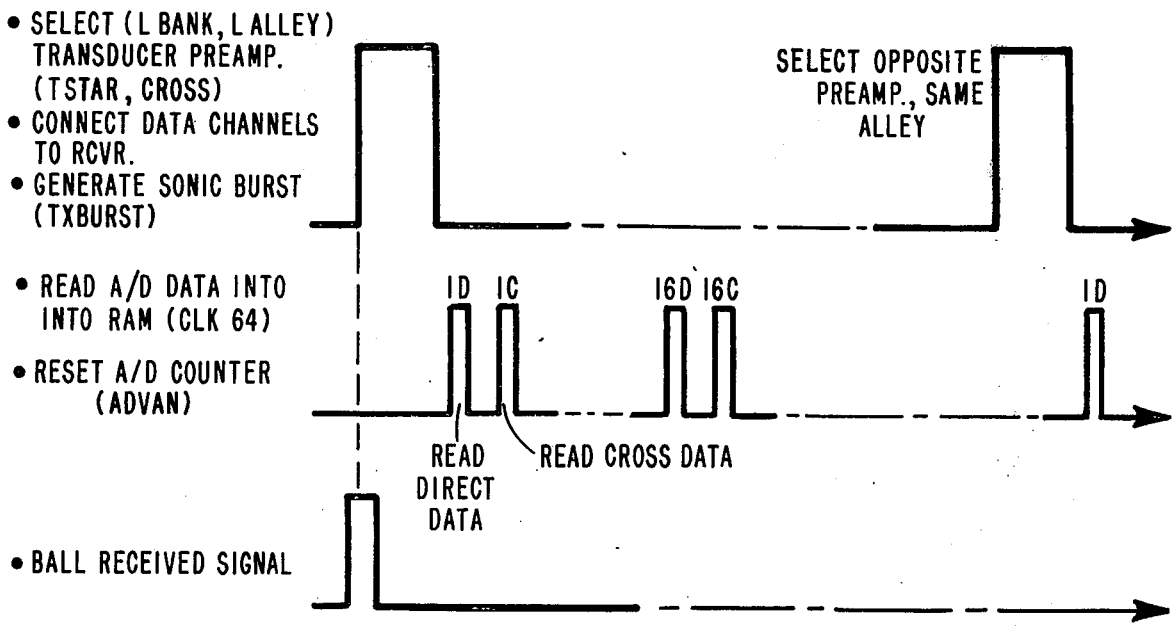
FIG. 5

ACOUSTIC BOWLING PIN DETECTION SYSTEM

FIELD OF THE INVENTION

This invention is directed to the field of bowling pin detection systems, and specifically electronic pin detection utilizing acoustic transducers.

BACKGROUND OF THE INVENTION

The method of detecting standing bowling pins in use in most commerical bowling establishments comprises mechanical switches or microswitches disposed on the pinsetter of a bowling machine which faces the predetermined positions of the ten pins. A certain time after the first ball is thrown, the pin setter is brought down to pick up the remaining pins. The presence and locations of the remaining pins is electromechanically signaled by the microswitches. The output signal from each of the switches is applied to an indicating lamp, and a count of the energized switches takes place to provide a pinfall count. However, this system suffers from both a slow operating speed and a tendency to jam.

A number of efforts have been made to eliminate mechanical pinsensors by replacing them with electro-optical bowling pin sensing devices. These detecting systems could not be placed overhead above the pins in a plane field of view, because the pinsetting apparatus occupies this space. The detection system could not be in the kickback wall on either side of the pin locations, because of the danger of damage to the optics by the bouncing pins. The optics could not be directly in front of the pin placements because of the necessity of maintaining a clear field of view of the pins from the front for the bowler on the alley. All these restrictions combine to require that the detection portion of the electro-optical system view the pins from an angle wherein the pins are partially obscured behind one another in angled rows.

In several known system light zoning techniques were utilized wherein the bowling pins are illuminated in a given time sequence. Photo-sensors are associated with each pin and are activated so that as each bowling pin is illuminated, that detector is synchronously interrogated to determine if the associated pin is standing. The result of such a system is that when a pin is displaced from its set position to a position which is adjacent to another pin, the light reflected from this moved pin and the unmoved pin will be detected by the same photocell and the two will be counted as a single pin. This presents the dual problem that an erroneous pin count will be made, and that an inaccurate representation of the actual standing pins will also result. Error also results when a pin moves to lie partially within two zones and is counted twice, again providing an inaccurate pin count and pin location map.

An effort to overcome these deficiencies is disclosed in Logemann et al, U.S. Pat. No. 3,847,394 which uses a plurality of television cameras mounted at angles in front of the bowling pin standing area to scan the standing area. The image on the TV camera screen is then scanned by a scanning beam to break the camera image down into minute segments. An effort is then made to assign each detected pin image to a preestablished pin identifying region. It is claimed that where pins move to present overlapping images, that a correct pin count is achieved; however, since the TV cameras are dealing with just a two-dimensional view of the pin field without any analysis of the depth of field, where a pin does move there can be no way of assigning that pin to its actual location. A further difficulty with this system resides in the use of the TV cameras which results in an expensive system to mount on a plurality of bowling alleys.

Only one known effort has been made in the past to use acoustic transducers which are much more impervious to physical damage from pinfall than electro-optic systems for detecting pin count and pin location. This system, disclosed in Eisenberg, U.S. Pat. No. 3,099,447 comprises inserting transducers in the alley under each pin spot. The electrical system for the transducer comprises a bridge circuit having an operating frequency set to the fundamental resonance of the transducer. The bridge is balanced in the absence of a standing pin; if a pin falls, the bridge becomes unbalanced and provides a signal to an indicating means. Thus, an indication of a standing or fallen state may be developed for each pin. However, this system of mounting transducers in the bowling alley, since it requires reconstruction of the most important portion of the bowling alley, is also quite expensive to install. Further, the embedded transducers are not able to differentiate between a pin which slides away from its assigned spot, and one which has fallen.

SUMMARY OF THE INVENTION

The subject invention is directed to a system wherein an array of acoustic transducers is mounted on each kickback wall beside the pin standing area. Preferably, each transducer is not mounted directly in line with a row of bowling pins, but slightly behind such a row and angled forward toward the front of the pin standing area. The two arrays are energized one after the other. Each transducer in the linear array on one kickback wall is sequentially energized with a burst of high-frequency sonic energy under microprocessor control. The reflected sonic energy is detected both at the transmitting transducer and at the next adjacent transducer. The use of the linear side-mounted transducer array allows for the development and analysis of direct data, that is, sonic reflections or echoes from pins directly back to the transmitting transducer, and cross data, that is, sonic echoes from pins back to the next adjacent rearward transducer. The combined direct and cross data enables the detection of pins which would otherwise be hidden behind a nearer pin to the transducer. The use of a linear array of acoustic transducers on each side of the alley provides not only coverage of the entire length of the pin standing area, but depth of field aross the pin standing area so that the locations of each standing pin may be accurately determined, while eliminating shadowing problems.

Pin location is determined by dividing the depth of the field of the acoustic return to each transducer into a plurality of range cells, using periodic sampling of an analog to digital thresholding coverter coupled to each transducer in turn. Separate converters are used for the direct and cross data signal returns. Pins are indicated by returns of significant magnitude, as fully disclosed in "Microprocessor Controlled Bowling Pin Detection System", W. R. Smith-Vaniz et al, S. N. 812,358, filed contemporaneously and incorporated herein by reference.

During the time that the acoustic return of significance is detected at each direct data transducer and each cross data transducer, the associated converter receives the resulting analog signal from the selected transducer, and converts it to digital format. The converter is periodically sampled to divide the total significant return period return to each transducer from each burst of acoustic energy into a plurality of cells. The converter includes a variable threshold device so that the magnitude of the return in each cell can be judged.

The use of the sonic method offers the unique advantages of no bolwing pin modification being required; a solid state embodiment easily mounted on existing kickback walls without modification of the axisting alleys; and being exceptionally impervious to dust, grime and the generally difficult operating conditions under which pin sensors must operate.

In the solid state embodiment of this device, the data provided by the arrays of acoustic transducers is analyzed under microprocessor control. This same microprocessor selectively controls the selection of each transducer, and initiation of the sound burst from the selected transducer. This is preferably done using a single shift register which not only gates a burst of high frequency energy to the transducer, but selectively gates the direct and cross data analog signal returns from selected transducers to a band pass amplifier tuned to the frequency of the sound burst carrier.

The data is converted to digital format in a peak-detecting analog-to-digital converter. The converter has a logarithmic encoding characteristic, using gain control for the least and most significant bits, and logarithmic threshold control for the other two bits. The counter of the A-D coverter is incrementally augmented when the encoding reference level of the comparator is less than the received signal amplitude. As a result, each counter content reading corresponds to the peak of the signal amplitude received since the counter was last reset. For each acoustic echo signal from a transducer being processed, the counter is reset a number of times equal to the number of cells into which the transducer's zone of effective coverage is to be divided. Thus, the peaks of the return data, indicating the position of the pins in the pin-standing region, are clearly indicated by this digitally-encoded, threshold compared, sampled data.

The sampled readings of the counter are stored in a random-access memory. The memory locations are assigned on the basis of signals indicating the time lapse between acoustic pulse transmission and echo receipt, and the linear position of the transducer providing the analog echo signal. In this manner, direct and cross fields of data are established for each linear array of transducers. Processing of the data is carried out. As a result, a determination of pin position, plus a pin count and thereafter the determination of the presence of absence of a split is accomplished. A data word is thereby created for transmission to an electronic score processing unit.

The system also includes unique means for detecting any interruption in the processing and transmission of data words to the lane score processing unit. In the event of detection of such an interruption, reset means are provided so that the data which must be transferred to the lane score processor is generated and transmitted.

BRIEF DESCRIPTION OF THE DRAWINGS

FIG. 4 shows in block diagram form the relationship of the basic elements of the system including the microprocessor chassis, and the preamplifier boards which connect the chassis with the transducers mounted in the kickback walls of two alleys.

FIG. 5 shows the relative timing of the basic functions which are required to effectuate the disclosed method of pin detection.

DESCRIPTION OF A PREFERRED EMBODIMENT

Figure 1:
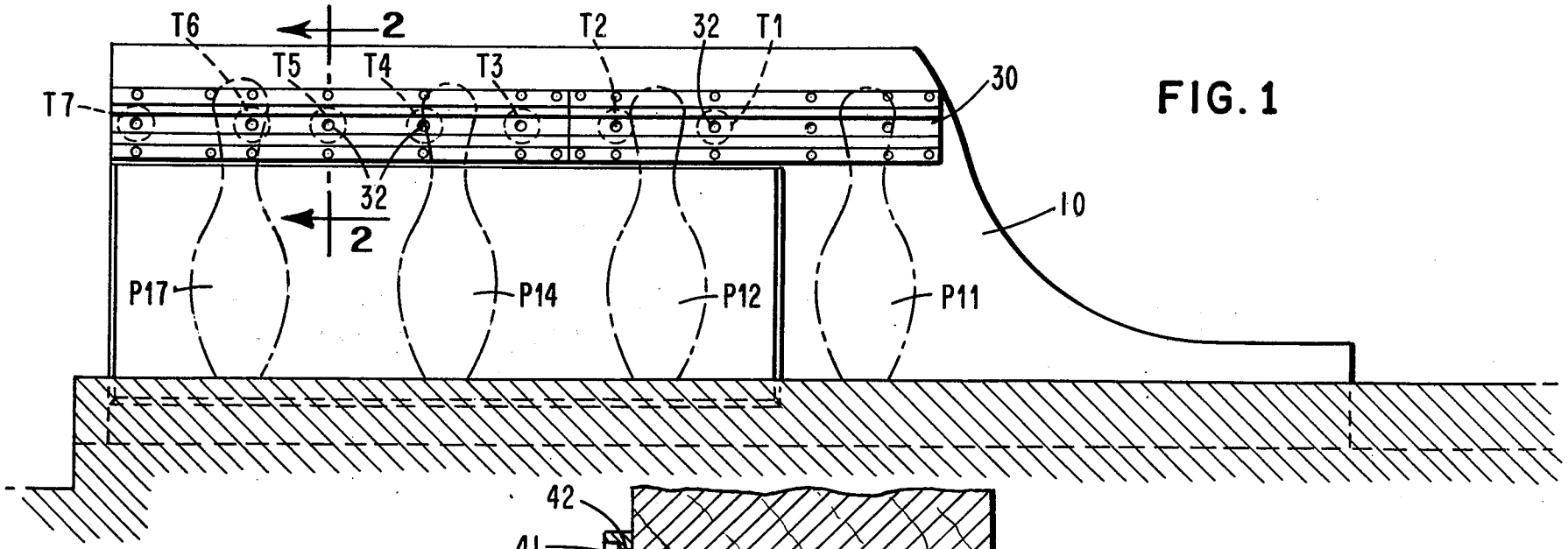
FIG. 1 illustrates the mounting of a set of acoustic transducers on an alley kickback wall.

The presence of standing pins is detected acoustically by a technique using as a data source a linear array of seven acoustic transducers T1–T7 mounted on the kickback 10 on either side of the alley. The transducers T1–T7 are mounted facing the pins P11–P20 as shown in FIG. 1. It has been found that the disclosed array when controlled as described below produces an overlapping pattern zones of effective coverage from the seven transducers, (FIG. 3) which provides sufficient information to detect the presence of a bowling pin standing anywhere in the pin-standing area, and eliminates the problem of one standing pin shadowing another standing pin.

Figure 3:
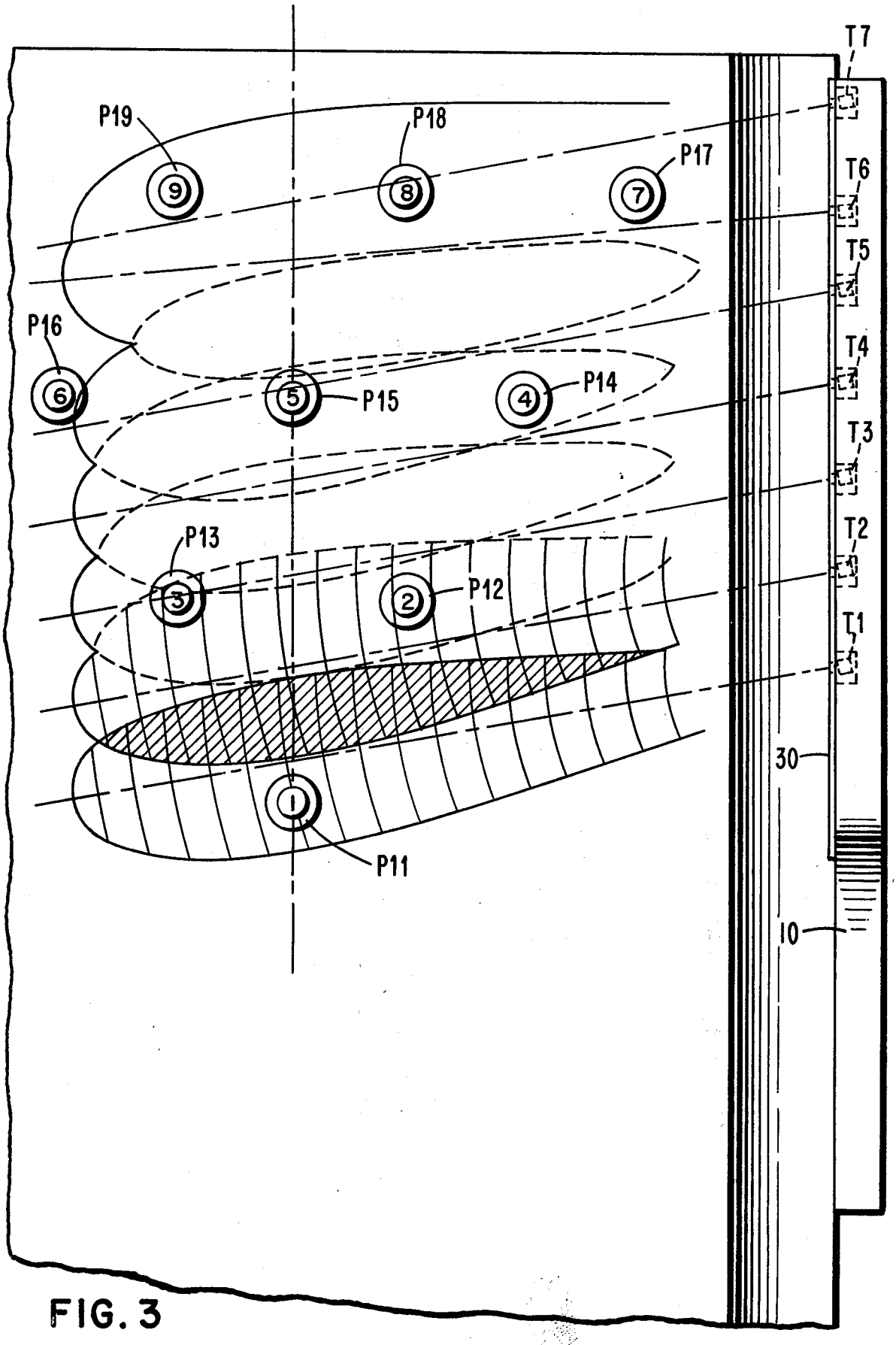
FIG. 3 shows in detail the sensor pattern of a plurality of acoustic transducers mounted in an alley wall, including the angles at which the transducers are turned and the zones of effective coverage, including overlaps.

It can also be seen from the polar plot of FIG. 3 that the effective range of the transducers is somewhat limited, so that an array of transducers T1–T7 must be mounted on each kickback wall 10 to provide sufficient effective coverage to detect the presence of each and every standing pin. It is for this same reason that a linear array mounted in the overhead in front of the pin standing area and scanning the area from front to rear is not as effective as an array of transducers mounted in the kickback wall.

The individual transducers T1–T7 are not placed directly in line with any row of pins, but are placed to bracket each row of pins with overlapping zones of effective coverage as shown in FIG. 3 to provide a maximum amount of signal information echo return from the area where standing pins are most likely to be found. Complete coverage of the pin-standing area is necessary because of the possibility that a pin will slide or move forward, backward or sideways from its nominal assigned position. Thus, transducer T1 is located somewhat behind the nominal position of pin P11 but is angled forward at an angle of 10° to cover the area including the nominal position of pin P11 plus the area to the rear of it. Transducers T2 and T3 both are placed slightly to the rear of the horizontal line which would run through the centers of pins P12 and P13. These two transducers are also angled forward at an angle of 10° to produce the overlapping pattern shown in FIG. 3.

Transducers T4 and T5 are also slightly to the rear of the center line running through pins P14, P15 and P16. These transducers are also angled forward at an angle of 10° to provide the necessary overlapping beam coverage. Finally, transducers T6 and T7 are located to pick up the standing pins standing in a line running through P17, P18, P19 and P20. It can be seen that the transducer T7 is located at the rear of the pin-standing area and that the transducer T6 is slightly ahead of the center line running through pins P7–P10. The reason for this is that since the pin-standing area ends only 6.25 inches to the rear of this P7–P10 center line, a lesser possibility exists of a movement to the rear of a standing pin from this line. To compensate for the transducer T6 being moved forward relative to the center line of the last pin, this transducer is angled toward the front at an angle of only 5°. The spacing of the transducers is as follows:

Transducer T6 is 0.607 inches forward of the center line running through pins P7–P10;

Transducer T7 is 5.594 inches to the rear of Transducer T6;

Transducer T5 is a 3.807 inches forward of transducer T6;

Transducers T4 through T1 are each spaced 4.800 inches ahead of the next transducer to the rear.

Figure 2:
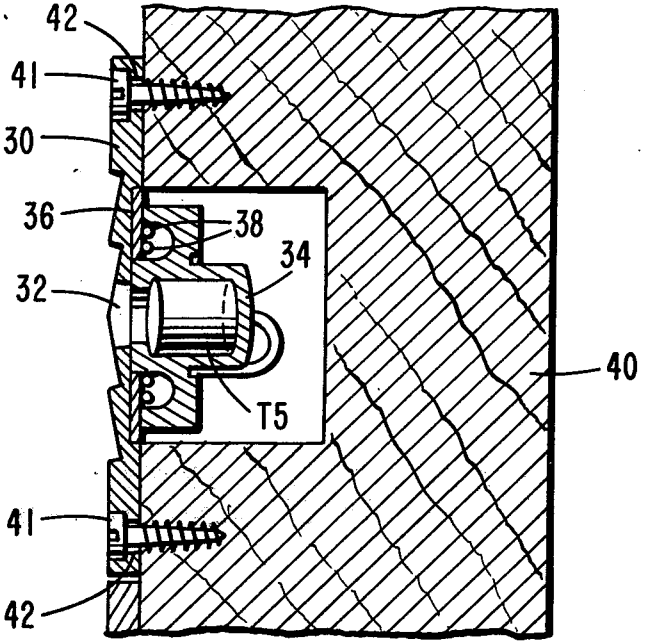
FIG. 2, taken on the section lines 2—2 of FIG. 1, shows the means by which a transducer is mounted at an appropriate angle in the alley wall.

Each of the rows of transducers is mounted behind a mounting strip 30 shown in cross-section in FIG. 2. Ths strip is designed having angled facings to bounce away sonic echoes that impinge on the strip in a direction towards the top or towards the floor of the pin-standing area so that unnecessary secondary return is minimized. The entrance hole 32 around each transducer is dimensioned to be unobstructive to the sonic burst transmitted by the transducer, but to be small enough to keep to a minimum the flat surfaces from which echoes can be reflected back at the pins, again thereby minimizing ghosts or double returns from a single transmitting burst. The transducer mounting device includes a cylindrical housing 34 which is angularly secured to a mounting plate 36 by securing means 38. The entire transducer mounting 30 is secured to the kickback wall 40 by fastening means 41 extending through apertures 42.

Returning to FIG. 1, the transducers T1–T7 are located so that the acoustic energy transmitted will strike a surface portion of each pin which is on the slightly concave area of the pin and approximately 12.75 inches above the pin-standing surface. The reason for this is that this area receives less damage than some of the other surface areas of the pins and therefore is likely to provide a cleaner reflection to the transmitting transducer. It is also a relatively thin portion of each pin, and less likely to be subject to shadowing effects. Even though the surface is concave, it is fully usable to provide the necessary reflection since the reflecting area is probably no more than about one square millimeter, and reflections will return to the transducer.

The specific transducers T1–T7 are chosen to have a radiation characteristic at an operating frequency of about 215 kilohertz to give the effective beam pattern coverage shown in FIG. 2. These transducers are based on designs disclosed in the following:

1. U.S. Pat. No. 3,928,777 "Directional ultrasonic transducer with reduced secondary lobes";
2. U.S. application Ser. No. 630,364 (1971 series), now U.S. Pat. No. 4,050,056, entitled "Electroacoustic transducer design for eliminating phantom target errors in sound ranging systems";
3. U.S. application Ser. No. 663,907 (1971 series) entitled "Method for Adjusting the Frequency Response Characteristic of an Ultrasonic Transducer".

The design of the acoustic transducers was established to provide a dynamic range of 25 db; with this range, even battered pins which severely scatter the impinging sound waves will be detected with substantial accuracy.

Turning to FIG. 4, the transducer array T1–T7 on each kickback 10LL–10RR is electrically connected through an associated transducer preamplifier board PR50–PR53 to the chassis CH60 comprising the microprocessor and associated memories (not shown) required for processing the transducer data return. Chassis CH60 processes the data from a pair of lanes 62, 64 on which a single bowler may bowl. The Chassis CH60, after analysis of the transducer data to produce a pinfall count, transmits the pin fall data to the lane score processing unit 70 for that pair of lanes.

In operation, the individual transducers T1–T7 (FIG. 6) are individually sequentially energized with a 215 khz signal, producing corresponding bursts of acoustic energy which spread out over the pin standing area in the pattern of zones of effective coverage shown in FIG. 3.

At the time each pulse burst is transmitted from a transducer, T1–T7, one or more associated multiplexer gates 101–117 (FIG. 6) are selectively opened to pass the analog signals representing reflections from standing pins to the processing electronics of chassis CH60. For example, when transducer T2 is the transmitting transducer then the analog signals representing the echoes received by this transducer are passed by direct data gate 102 to chassis CH60 to form a part of the direct data pattern field. Simultaneously, the echoes signals provided by the next adjacent rearward transducer T3 are also gated to the chassis to be processed into digital format and form part of the cross data field.

Figure 6:
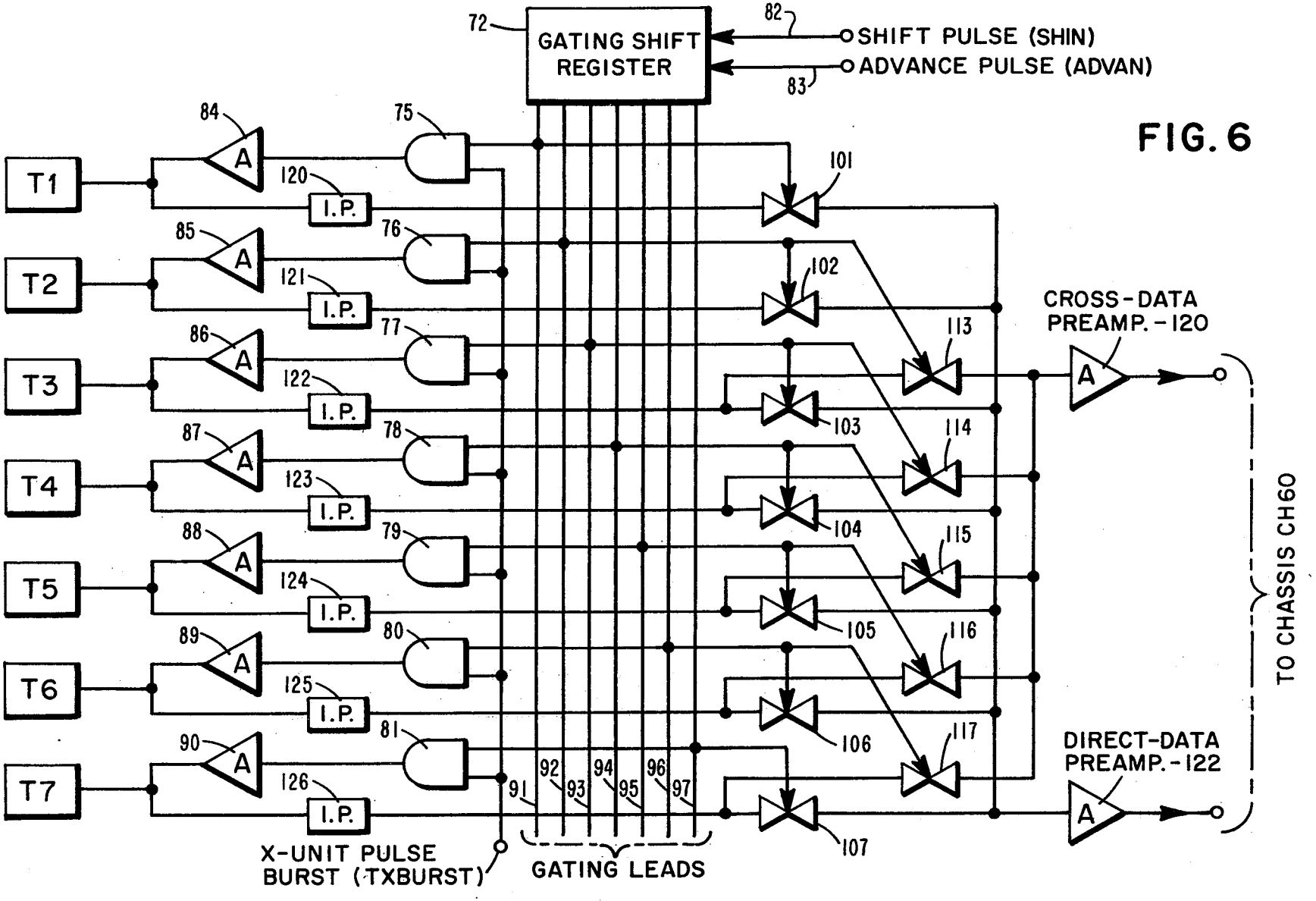
FIG. 6 is a diagram of the preamplifier board which controls the selection and energization of a set of transducers mounted on a kickback wall.

The gating means of FIG. 6 select a transducer for transmitting an acoustic burst as well as the transducers whose analog outputs will comprise the direct and cross data.

Specifically, FIG. 6 shows the shift register 72 used to selectively address one of burst gates 75–81 leading to the transmitting transducer, one of multiplexer gates 101–107 (determining which direct data analog signals are to be analyzed) and one of multiplexer gates 113–117 determining which cross-data analog signals are to be analyzed).

Specifically, to address a particular one of transducers T1–T7, the gating shift register 72 of the selected transducer preamplifier board PR50–PR53 is initialized with a shift pulse SHIN on line 82. The resulting output of shift register 72 is stepped to each register output line 91–97 in succession by a corresponding number of advance pulses ADVAN on line 83. As each transducer on a given preamplifier board is selected, it is energized by a burst of 32 pulses at the 215 khz rate. The relationship of these three signals sent to a single preamplifier board appears in FIG. 8. It is important to note that four preamplifier boards PR50–PR53 servicing both lanes 62,64 on which a bowler may bowl, are controlled from a single chassis CH60; therefore, the means in the chassis for transmitting pulse SHIN is actually the means that selects one of the four preamplifier board PR50–PR53 for pinsensor data generation activity.

After initiation of a preamplifier board by the pulse SHIN, then the seven pulses ADVAN open the associated gates 75–81 in turn via leads 91–97. These select and gate pulses are transmitted from the chassis, that is the controlling microprocessor, via the peripheral interface adapter shown in FIG. 9 and explained in detail below. The chassis then transmits a sequence of 32 pulses at the 215 khz repetition rate. This pulse sequence is amplified by one of amplifiers 84–90 and applied to drive the selected transducer. Return echoes are selectively gated back to data preamplifier 120,122 by the multiplexer gates 101–117 selectively opened by the same gate selection signal which enabled a single transducer for transmission purposes. The direct data is gated back through gates 101–107 to the direct data preamplifier 122; the cross-data is gated back to the cross-data preamplifier 120 through gates 113–117. After appropriate amplification by these preamplifiers, the analog signals representing the data return are transmitted to the chassis. Considering for example, the operation of a specific transducer T2, it can be seen that line 92 forms one of the two inputs to a standard AND gate 76. The other input to gate 76 is the 32 pulse sequence (TX Burst) which constitutes the high frequency burst of sound to be sent from the transducer T2 to produce to reflected sound information. The output of this AND gate 76, when selected by register 70, is applied through a driver amplifier 85 to the transducer.

The same advance gating pulse which selected and opened one of the seven possible driver gates 75–81 also selectively opens the associated receiving multiplexer gate 102 of the set of multiplexer gates 101–107. This transfers the direct data analog signals to direct data preamps 122. It can be seen that the same gate signal on lead 92 in this instance is applied to the control line of two multiplexer gates 102 and 113. Multiplexer gates 102 is associated with transducer T2, and receives the reflections returning directly to the transmitting transducer as a result of the transmitted sound burst (i.e., direct data). The multiplexer gate 113 has an input from transducer T3, although the reflections received in this instance are caused by the sound burst transmitted by transducer T2 (cross-data). The information from multiplexer 113 is transferred to cross-data preamplifier 120. The data received from the two preamplifiers 120, 122 of ech preamplifier board PR50–PR53 is transferred to chassis CH60 for processing.

The use of cross-data, that is, sound reflections received by a next adjacent transducer (e.g. T3) to the energized transducer (T2), is a key innovation for dealing with pins shadowing one another by providing increased analysis of overlapping transducer beam areas. It allows for discrimination between two pins located in the non-overlapping areas of two adjacent transducers, and one pin located in an overlap area, both of which cases produce direct data analog signal return echoes at both adjacent transducers. These two pinstanding situations can be readily distinguished through this invention, because the associated cross-data is present only in the latter of the two cases.

It is apparent from FIG. 3 that only when one of transducers T2–T6 is selected as the transmitting transducer are both direct and cross data signals transferred to chassis CH60 for analysis. The reasoning is that transducer T1 has a pattern as shown in FIG. 3 which does not create any pin overlap detection problems. The transducer T7 does not have any transducer adjacent to the rear, and therefore there is no next adjacent rearward multiplexer gate to be energized. The deflection angle of transducer T6 is modified from the normal 10° to a 5° angle to provide additional information about the positioning of the four pins in this last row.

Figures 7, 8, 11:
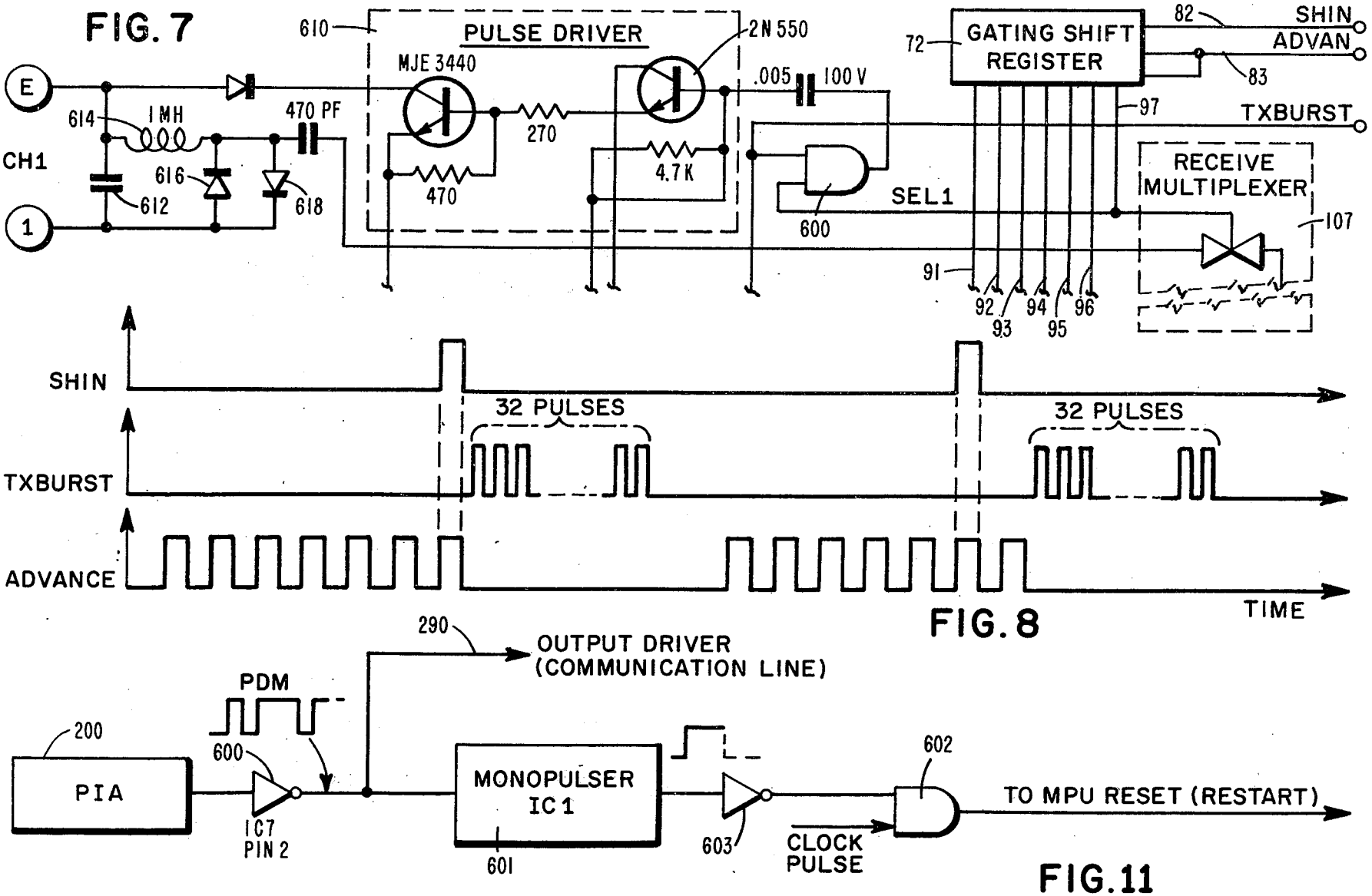
FIG. 7 shows in detail a portion of the preamplifier board.
FIG. 8 is the timing diagram for a single preamplifier board used to control the transmission of acoustic energy from a series of seven transducers mounted in a kickback wall.
FIG. 11 is a block diagram of the data output protection circuit for the chassis.

The structure of a typical pulse driver amplifier, i.e., one of amplifiers 84–90, and of a typical input protection circuit, i.e., one of circuits 120–126 is shown in the schematic diagram of FIG. 7.

The output of the second transistor in the pulse driver circuit drives the selected transducer with the pulse burst. Return echoes are received by the same transducer. The resulting analog signal output of the transducer is applied to a receive network including capacitor 612 and inductor 614, and then applied to the selected receive multiplexer gate through the protective network including diodes 616,618. The output of the enabled multiplexer gate is passed through a preamplifier for transfer to the chassis of FIG. 10.

Figure 9:
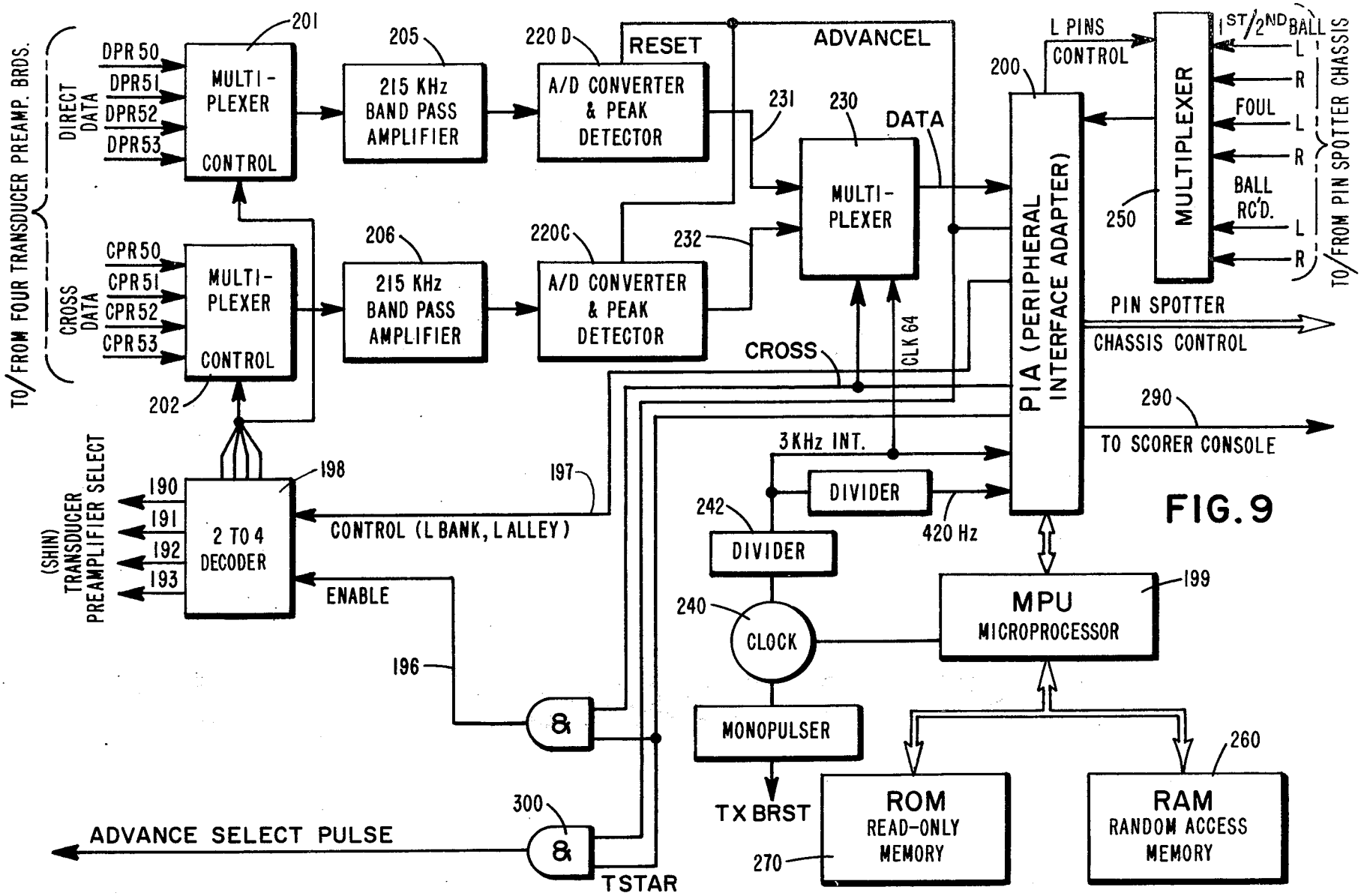
FIG. 9 is a block diagram of the chassis which controls the timing of the system and collects and analyzes the echoes represented by analog signals from the transducers.

The information from each of the four transducer preamplifier boards PR50–PR53 (FIG. 4) which provides pinstanding information on two alleys 62,64, is analyzed in a common microprocessor controlled chassis CH60 whose essential elements are shown in block diagram form in FIG. 9. Certain subsystems designed specifically for incorporation in the chassis of FIG. 9 are shown in detail in FIG. 10.

It has been explained with respect to FIG. 6 that each preamplifier board is selected by a pulse SHIN from the chassis CH60. This selection pulse is made by a 2–4 decoder 198 shown on the lower left of FIG. 9 and comprises a four output decoder having two significant input selection signals (LBANK, LALLEY) received on control lines 197, and an enable signal received on line 196. On the basis of the two control signals received on the control lines 197 from the microprocessor 199 via the peripheral interface adapter (PIA) 200, only one of the four outputs 190–193 is selected. The control signals which appear on the control lines are denominated LBANK indicating the left lank of transducers, the LALLEY representing the left alley. For example, if LBANK is high, then the left bank of transducers is to be enabled by decoder 198; if LBANK is low, the right bank of transducers is to be enabled. Similarly, the state of the LALLEY signal selects the left alley or right alley. The two control signals are developed by the microprocessor 199 in accordance with ball indicating signals received from the pinspotter chassis (not shown) via multiplier 250 and PIA 200.

The data returns from each of the preamplifier boards PR50–PR53 (FIG. 4) come into multiplexer control 201,202 on the lines marked DPR50–53 (direct data return) and CPR 50–53 (cross-data return). Multiplexer control 201,202 comprises two separate sets of multiplexer gates of the same type as found on each preamplifier board; these multiplexer gates (FIG. 10) are selectively enabled by select signals corresponding to the preamplifier board select signals from two out of four decoder 198. The multiplexer control sections 201,202 thereby provide additional isolation between the A-D converter section 220 appearing in the center of FIG. 9 which converts the analog input from the transducers into digital quantities, and the individual preamplifier boards PR50–PR53. Thus, at any given time, a signal SHIN appears on only one of the four output lines 190–193 leading to a transducer preamplifier board, enabling that board to transmit acoustic signals from the transducers and pick up reflected sound energy. The signal from the same decoder 198 enables a single direct data multiplexer gate of gates 401, 403, 405, 407 (FIG. 10) in multiplexer control 201; and a single cross data multiplexer gate of gates 402, 404, 406, 408 (FIG. 10) in cross data control 202. The enabled gates have inputs connected to the preamplifier board enabled by the same signal SHIN. The outputs of all direct data gates 401, 403, 405, 407 are tied together by a common output line to 215 kilohertz band pass amplifier 205; similarly the outputs of cross data gates 402,404,406,408 are tied in common to band pass amplifier 206. The pass bands of these amplifiers, designed to be about 15 khz wide, are about the frequency of the burst of transmitted acoustic energy. The outputs of the band pass amplifiers, comprising the analog signals representing acoustic reflections from standing pins, are applied to the analog-to-digital converter section 220. Separate sections 220D, 220C are provided for digital conversion and peak detection of the direct data and of the cross data returns.

Each analog-to-digital converter **220*d*, 220*c* has a logarithmic encoding characteristic; that is, the threshold of the converter is incrementally augmented each time that the encoding reference level of the comparator is less than the received signal amplitude. In this embodiment, the threshold of the converter comparator 422 is stepped up by 2 DB each time the incoming signal exceeds the existing threshold. The threshold can be raised to a maximum level about 28 DB above the starting level, after which the output of the comparator, stored in a counter 420**, ceases increasing.

For each burst of 32 pulses of acoustic energy from a transducer, the magnitude of the acoustic signal return defined by the counters of converter 220 is sampled 16 times. Thus, the pattern of effective coverage for each transducer is divided into 16 range cells (note, for example, the pattern for transducer T1 in FIG. 3); a digital representation of the magnitude of the signal return level is stored for each cell. Analysis of these signals for locations of the returns of maximum strength establishes the precise location of each standing pin. Each time the counter is read, it is reset to zero, reseting the threshold of the converter to its lowest value. In incrementing the threshold level of the converter to establish the magnitude of the acoustic signal return and converting it to a digital value, the converters **220*d*, 220*c* use gain control for the least and most significant bits, and logarithmic threshold control for the other two digits. The gain and threshold control means are under the control of the outputs of the counter. Thus, the counter content at all times corresponds to the peak of the signal amplitude received since the counter was last reset. Protective logic is also provided to prevent the counter 420** from overflowing due to an unusually large signal amplitude.

As will be described below and with reference to FIG. 5, the signals which coordinate the sampling of the counters in the analog to digital converters 220D, 220C also enables the selection of a preamplifier board, by the signal SHIN and the sequential selection of each transducer on that board with stepping pulse ADVAN so that the operation of the entire system is time coordinated.

Thus, the same signal ADVANL from processor 199 via PIA 200 controls the reset of the counters 420D,C in the analog to digital converter sections 220D,C after each range cell reading, and also controls generation of the preamplifier board advance gate pulse ADVAN by way of AND gate 300. The signal TSTAR, which remains high as long as the acoustic return from a single transducer burst is being examined, controls the actual time of generation of each advance gate pulse ADVAN, and the generation of the preamplifier board section pulse SHIN..

As can be seen in FIG. 9, after digital encoding, the data stored in the counters of the two analog-to-digital converter sections **220*d*, 220*c* is transferred to the microprocessor 199 under control of a CROSS signal which is an input selection signal, and a clock signal CLK64. The multiplexer 470 FIG. 10C, has two sets of inputs, one set 231 for conveying direct data signals from counter 420D, the other set 232 for conveying cross data signals from counter 420C. The CROSS signal switches the multiplexer from one set of inputs to the other, so that the direct and cross data representations of the echoes to adjacent transducers resulting from the same burst of sound and having the same elapsed time coordinate representing time from transmission to time of receipt are read alternately. The clock signal CLK64 runs to a flip-flop 460 in the multiplexer section 230. This signal, at a repetition frequency of 3KHz, sets a hold line to the converter counters 420D, C at a regular interval so that the counter does not change state while being read by processor 199**.

Each digitally encoded range cell data sample is transmitted via multiplexer 230 to the peripheral interface adapter 200, FIG. 9. The PIA 200 is preferably a Motorola MC6820 for interfacing all peripherals and memories with the Motorola MC6800 processor 199. The microprocessor 199 is interrupted at a 3 kilohertz rate by the system clock 240 through a divider 242, by way of the PIA 200.

During each one of a second series of interrupt signals at a repetition frequency of 420 Hertz the microprocessor executes software by which it checks the status of the input signals from the pin spotters which are received via multiplexer 250. Specified bit locations in random access memory 260 are set depending on the presence of absence of such signals. Therefore, as signals are received from the pin spotter, (see FIG. 5) they are stored in the random access memory 260, and consistent with the programs stored in read only memory 270, control signals will be developed, e.g., LBANK, LALLEY, to select a particular lane and preamplifier board for examination of the standing pins.

The chassis also recognizes foul signals, first or second ball state, and ball received signals received from the pin spotter chassis (not shown). These signals are developed as a matter of course in known pin spotter chassis as presently installed and operating on existing bowling alleys. In response to these signals, in addition to the preamplifier selection signals identified above, the microprocessor 199 transmitts "do not sweep" and "do not respot" commands to the pin spotters depending on the pattern of standing pins which is detected by the acoustic transducers sensing pattern. The do not sweep command is issued when a miss, a seven pin down only, or a ten pin down only pattern of pin fall is detected. The do not respot command is transmitted to the chassis when a miss or a strike are detected. Because of the high speed of the microprocessor electronics and the detection system, these signals can be developed and transmitted without delaying the action of the electromechanical pin spotter. As a result, a further speedup in play is produced by the elimination of unnecessary sweeping and movement of the table. This check of incoming signals from the pin spotter chassis occurs during each interrupt at the 3 kilohertz rate.

In addition, during every 7th interrupt, the output voltage of the communications line 290, FIG. 9, scorer console is updated. Data representing pinfall count, first or second ball and existance of a split is transmitted in a pulse with modulated code: "0" equals a pulse width of two intervals; "1" equals a pulse width of five intervals; left lane delimiter or indicator equals a pulse width of eight intervals; a right lane delimiter equals a pulse width of eleven intervals.

The first interrupt signal at the 420 cycle rate that occurs after detecting receipt of a ball causes the microprocessor 199 to execute the scanning software by which each particular transducer is selected and the corresponding direct data and cross data channels are connected to the analog receiving circuitry described above. Having accomplished selection of a preamplifier board and a transducer on that board, the software causes a burst of ultrasonic sound to be generated by the selected transducer. After that activity, the microprocessor resumes processing the task it was executing when the interrupt occurred. Meanwhile, sonic echoes are received by the connected transducer (or transducers in the case that two multiplexer gates are opened) and the corresponding electrical transducer signals are amplifed by the preamplifiers 120 and 122 of the preamplifier board. The preamplifiers transfer the enhanced signals to the chassis CH60 (FIG. 4) where they are converted into digital codes by the analog to digital converter section 220. As disclosed, this A-D converter section has a digital code count which is augmented incrementally whenever the input signal exceeds the amplitude represented by the basic digital code.

The next interrupt to the microprocessor after the transducer enable interrupt causes the microprocessor to read the contents of a counter 420 C or D in the A-D converter section 220 and store this content in random access memory 260 for later processing. The counter 420 is then reset for accumulation of another range cell magnitude value over the next interrupt interval. By this means, each burst of sound from each transducer causes a signal return which is divided up into a plurality of 16 range cells each represented by the comparative magnitude of the echo. Thus, for each burst of sound from, for example, transducer T2, its effective zone of coverage is divded into 16 range cells of direct data and 16 range cells of cross data, each represented by the magnitude of the signal return in the time period defining that cell. Each range cell magnitude is stored in random access memory in a position of a direct data field or cross data field according to two coordinates: one coordinate represents the position in the linear array of the receiving transducer; the other coordinate represents the time lapse between sound burst transmission and receipt of this sample of the total return.

After storing the accumulated count in the counter 420 for each range cell, the microprocessor 199 again returns to processing the task it was executing when the interrupt occurred. This sequence of checking the status of the A-D converter 220 and storing the direct data value and then the cross data value is repeated 16 times, covering the full depth of the range or coverage zone of each transducer.

After the 16th range cell testing interrupt, prior to returning from the interrupt, the next transducer is selected and corresponding new data channels are connected to the receiving circuitry by means of the 2 to 4 decoder 198. Then a sonic burst is again generated. The following 16 interrupts cause the microprocessor to retrieve the data from the analog to digital direct and cross data converter sections 220 D, C, as described above, after which transducer data channels are again selected. This process is repeated until all the transducers on both sides of the lane where a ball receipt was detected have been activated in series sequence proceeding from front to back proceeding first down one side of the lane (transducers T1–T7 on wall 10LL of lane 62, for example) then down the other side of the lane (wall 10LR).

The scanning software of the routine then becomes dormant until receipt of a ball is again detected and the process is then repeated. FIG. 5 illustrates the relative relationship of the major events in the pinfall data acquisition sequence which has been described above.

On completing the acquisition of pin fall data by the interrupting scanning software routines, a flag is set in the random access memory 260 by the routine. This is checked by the processor and on its detection, the processing routines are entered.

In principle, the processing routines perform the task of recognizing patterns of standing pins from the fields of direct data and cross data stored in a memory array in random access memory 260. During a first preprocessing pass, the cross data is used to correct direct data returns and create data patterns representative of single pins that stand in overlap areas, i.e., pins for which data return is confined to cross data memory cells. By these means, the absence of direct data return from a standing pin standing in an overlap or shadowed area is accounted for, so that accurate detection of every standing pin is enabled. Single pins in overlap areas are thereby recognized even if the direct data associated with the pins is absent due to shadowing effects or surface scatters that may greatly attenuate the reflections, provided that the cross data is significant. The arrangement of transducers as disclosed herein is adapted to provide such significant data returns as is necessary to detect each standing pin. Carrying out a second preprocessing pass, data from the transducer array of the left bank of a lane is combined with that of the transducer array of the right bank of the same lane to obtain one data pattern for each pin as it is seen by both arrays. Of course, as apparent from the map of FIG. 3, because of limits to the zone of coverage of some pins such as the seven pin and ten pin will have data stored in range cells associated with only one transducer array.

If the data relative to a single probable standing pin from both transducer arrays corresponds, then the data from the side nearer the pin is emphasized and the data from the farther side is discarded. During the subsequent processing pass, the remaining data is peaked, that is, data in adjacent cells is compared until each pin is represented by a datum stored in but one memory location. The number of occupied memory locations is then counted to get to the actual pin count. Pin numbers are assigned to the standing pin on the basis of a root mean square deviation from an optimum pin position of the data location in which the single datum is stored from the optimum datum location. Splits are then calculated on the basis of the pin numbers assigned, and a communication word of eight bits in length is created for transfer to the lane score console.

The communication routine fetches this data word and transmits it to the scorer console over console output 290 via pia 200. The four least significant bits of this communication word represent the pin fall count; the fifth bit designates first or second ball data; the seventh bit designates a split; the other two bits are used for housekeeping pruposes.

The following is a more detailed description of the operational basis of the processing of the transducer data which results in pin fall identification.

The pin deck is covered by 14 acoustic transducers, seven to a side. (See FIG. 3). It is necessary to find pins anywhere in the legal area and to accommodate variations in reflectivity, which means that a pin may appear in the beams of several transducers from each side and in several range cells, appearing as a cluster of echoes when plotted on a map of the deck. The data reduction problem consists mainly of identifying which echo groups correspond to a single pin and, incidentally, the physical location of that pin.

The data available to the processor consists of 4-bit words representing the echo strength in each of 16 range cells for each transducer, plus corresponding echo strength data received from the transducer immediately behind the one which is selected for transmission. The first processing step "cleans up" the data from one transducer (and the transducer behind it) by extracting peaks from the range data and by making repeated scans until agreement is within limits. Data received on the same transducer which made the transmission will be called "direct" data; that received from the next transducer behind will be called "cross" data.

The range resolution is quite good if limited as shown in FIG. 3 and divided into range cells as disclosed. This assures that if two echoes appear in the reduced data there are two pins present. However, a pin acoustic echo may appear in the output signals of several transducers, and it is necessary to elaborate the data reduction for a "string" of pins which appear at the same range in adjacent transducers. In particular, two pins in line along the alley and fairly close together may result in a single "string".

Since amplitude thresholding proved unreliable in separating long strings, it became evident that a method taking better (and more systematic) advantage of the amplitude could improve matters.

For purposes of this discussion, it is convenient to call each echo amplitude a "mass" located at its corresponding point on the pin deck, and to discuss the process in terms of the familiar mechanical quantities mass, center of gravity, and moment of inertia. When a "string" has a single reasonably narrow peak, the center of gravity (CG) of its echoes will be a good approximation of its true position and its radius of gyration about that center will be low even though there are echoes in several transducers.

On the other hand, if the string is the result of two pins, the large echoes will be spread out over a longer region (and usually show two peaks) and the radius of gyration about CG will be much larger. In this case, the CG represents the midpoint between two pins and the radius of gyration is the distance from that point to each of the two pins.

Note that the important quantities are independent of the total "mass"—i.e., overall system sensitivity is less important than in an amplitude—thresholding system. The sensitivity requirements become:

transducer sensitivities must be reasonably similar sensitivity must be high enough to assure finding all pins sensitivity must be low enough not to pick up spurious signals and not to smear the strings beyond recognition In practice, the transducers are interrogated in sequence from right to left and front to back, reducing the data as far as possible at each step. Strings are "tracked" separately for each side, the total mass, moment, and moment of inertia being updated for each increment. A string is begun when the direct data occurs more than one range cell away from any old string—a string ends when no direct data appears within one range cell of the string.

When each string is completed, its CG and radius of gyration are calculated from the tracking data. From these numbers are computed the number of pins (one or two) and their positions. Each pin so found is compared with the positions of all pins already identified from the other side. When both X (range) and Y (transducer number) data coincide within tolerance, the data corresponding to the transducer bank nearer the pin location is selected and the other is discarded, otherwise the new pin data is entered into the list as a pair of coordinates.

Since the transducers are not evenly spaced in position or angle, the number of transducers which might see a pin in a given spot varies widely. Moreover, this situation changes with range. Therefore, the threshold against which the radius should be compared is a complicated function of its position. This problem has been solved empirically by incorporating a two -dimensional threshold table (X,Y) which was originally derived by moving a single pin through the field and tabulating the maximum radii found.

After the last transducer has been interrogated and the last strings have been closed out, the length of the list of X-Y coordinates is the number of pins standing. It is now necessary to identify these pins both for determining splits and controlling the lights in the mask. Note that one of the requirements is that, wherever they may lie, no two pins may be assigned to the same nominal location.

Identification is accomplished by forming a list of the minimum distances from each nominal location to any actually found pin, sorting the list of these minima, and identifying as present enough of those with the smallest distances to account for the number of pins known to be standing.

Figure 10A:
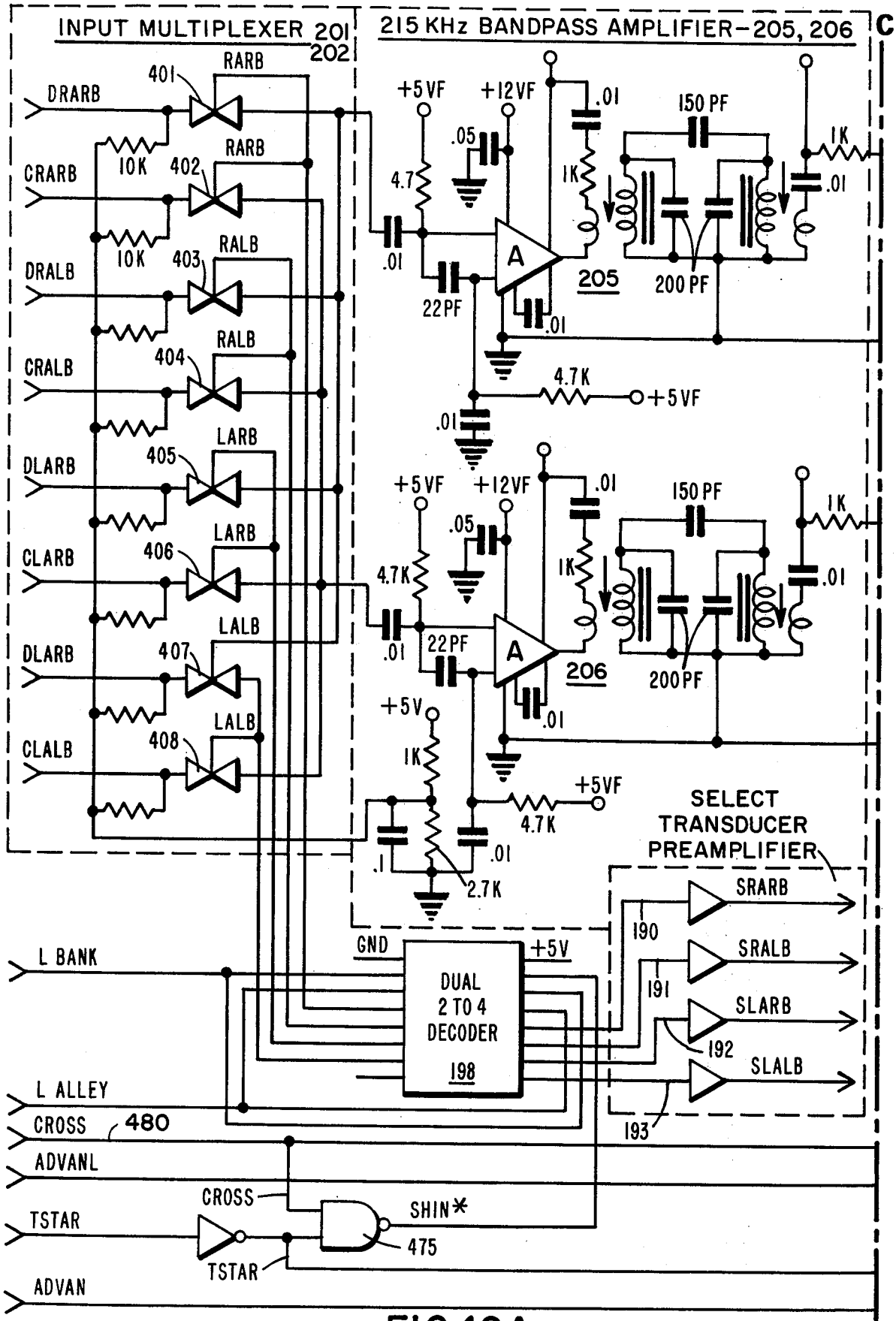
FIGS. 10*a*–10*c* are a detailed schematic of significant portions of the chassis.
Figure 10B:
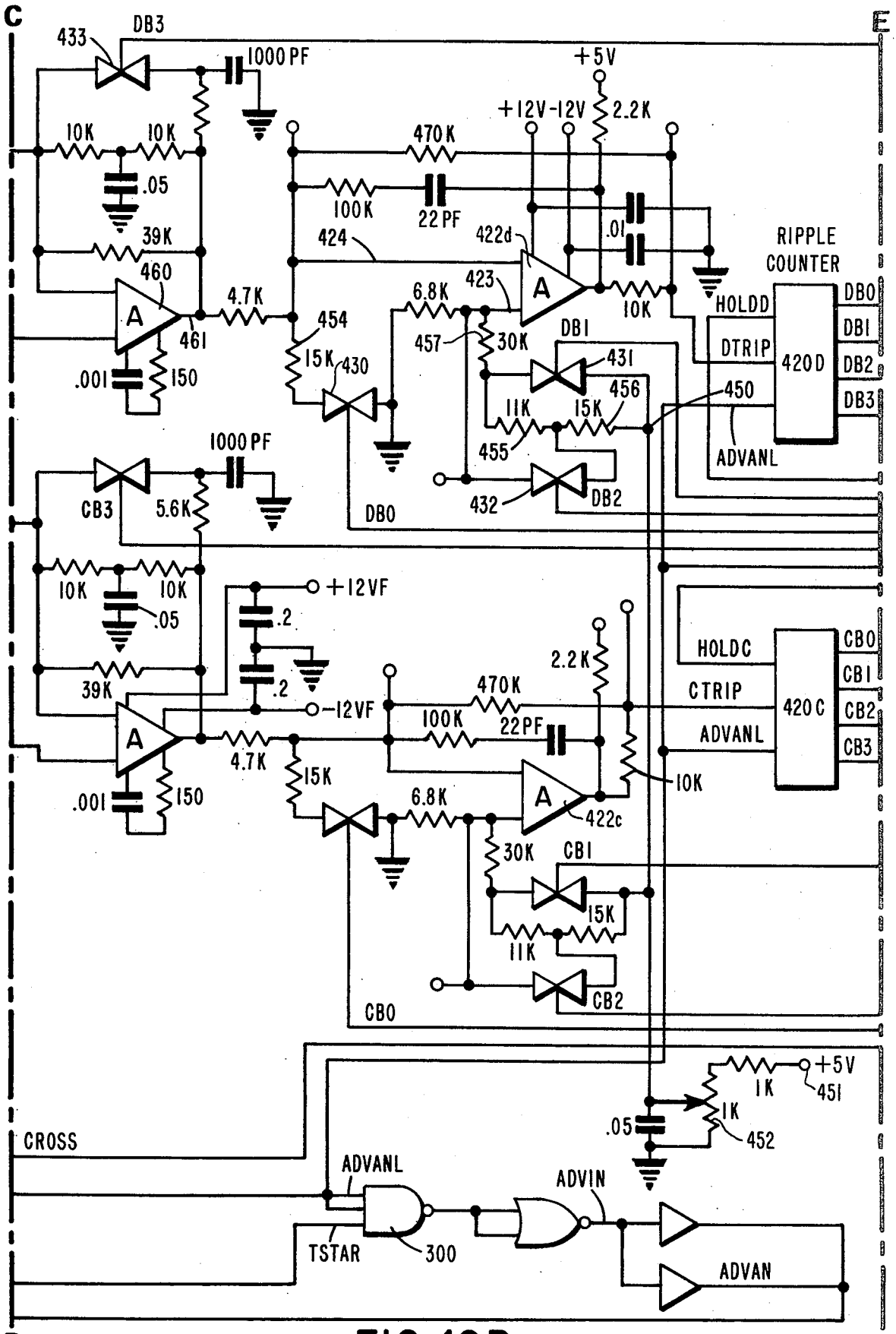
Figure 10C:
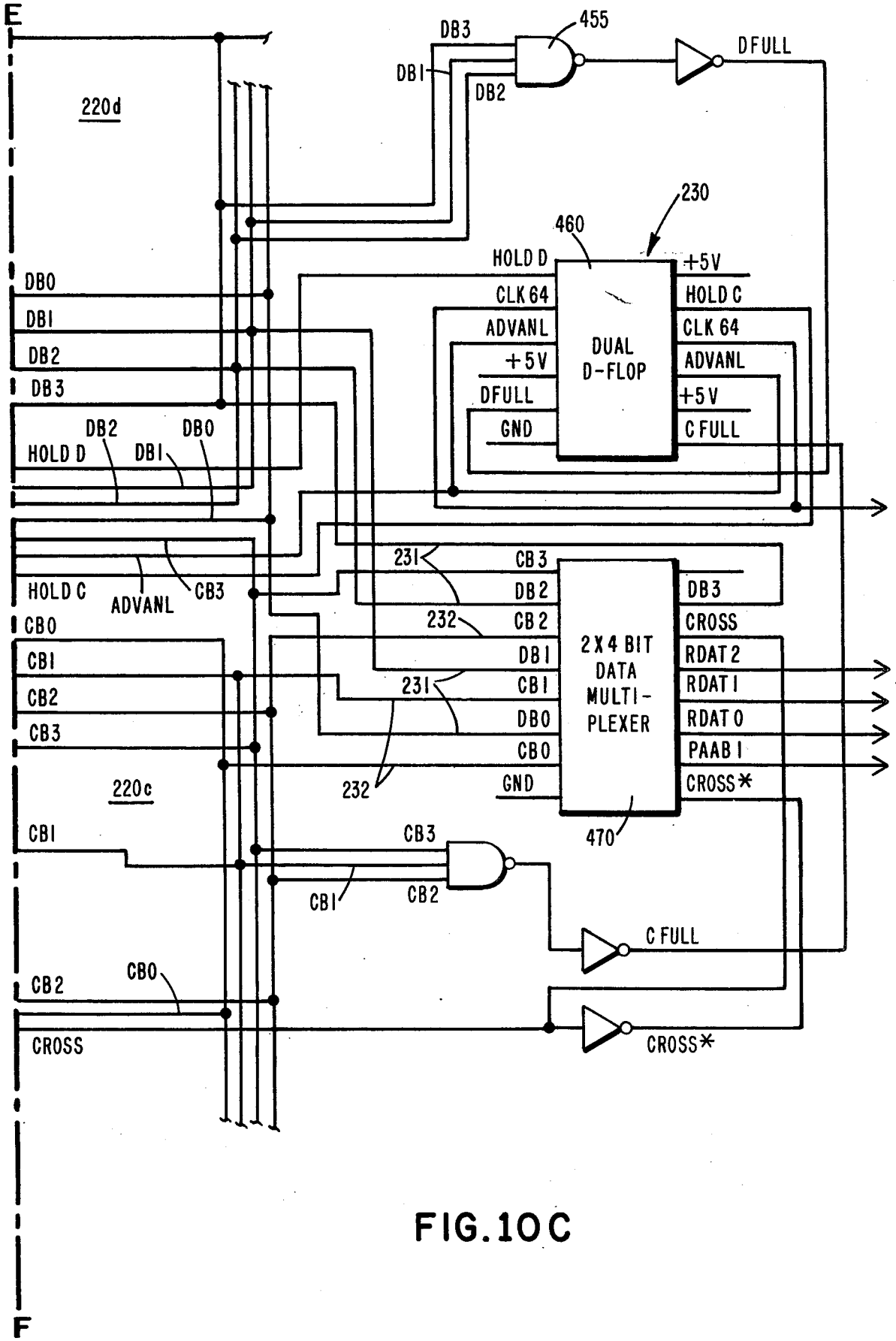

The schematic diagram of FIG. 10 shows in detail certain structural elements which were especially designed to implement the claimed processor. These include the input multiplexer to the chassis 201, 202; the two band pass amplifiers 205, 206 which are tuned to the 215 khz frequency at which sound bursts are transmitted by each of the transducers; and the logarithmic analog-to-digital converter 220 for converting the acoustic signal information return into a digital format compatible with the processing program of the microprocessor.

The two out of four decoder 198 selects, on the basis of the LBANK and LALLEY signal inputs from the microprocessor 199, any one of the four preamplifier boards PR50-PR53. The microprocessor 199 develops the LBANK, LALLEY control signals as a function of ball received signals coming from each alley (L,R) over multiplexer 250 and PIA 200. These preamplifier boards, one of which is shown in detail in FIG. 7, are separated from the chassis electronics and located close to the associated transducer banks to reduce noise to a minimum.

The preamplifier board which is to be transmitting data to the chassis at any given time is selected by a signal labelled SHIN on the timing diagram of FIG. 8 which shows the timing of a single preamplifier board. Thus, the shift register 72 functions as both a preamplifier board selection device (in response to signal SHIN) and a transducer selection device (in response to signal ADVAN). The preamplifier boards are selected one at a time by the signals SRARB through SLALB from decoder 198 (FIG. 10). The letters RARB, for example, stand for "right alley, right bank of transducers"; the letters LALB stand for "left alley, left bank of transducers". Signals from this same decoder are used to control the flow of the corresponding direct and cross data analog inputs from the preamplifiers boards through the chassis input multiplexer 201, 202. Specifically, as each preamplifier board is selected, the control signals from the dual two-to-four decoder 198 open a multiplexer gate in each portion of the input multiplexer, one for the corresponding direct data output from the selected preamplifier board and the other gate from the cross data output from the selected preamplifier board. The use of these selectively enabled gates provides additional isolation between the preamplifier boards PR50–PR53 and the band pass amplifiers 205, 206 of the chassis of FIG. 10.

The outputs of the four direct data input gates 401, 403, 405, 407 and the four cross data input gates 402, 404, 406, 408 are separately coupled to two 215 khz band pass amplifiers 205, 206. These band pass amplifiers have a 15 khz pass band, and are tuned to the frequency of the 32 pulse burst which is transmitted by the selected transducer. The same frequency characterizes the received reflections from the selected direct data transducer and the selected cross data transducer. The band-pass amplifiers 205, 206 are constructed in accordance with known principles; pertinent component values are shown in FIG. 10.

The analog-to-digital converter 220 comprises two sections **220*d* for digitizing direct data and 220*c* for digitizing cross data. Each section 220D,C continuously converts the received analog acoustic echo signal return into a digital quantity. This digital count is periodically sampled to divide the acoustic signal return into a plurality of range cells to be used to form the direct data map or the cross data map of each transducer array. The key features of the analog-to-digital converter 220, only one section of which shall be described as the sections are substantially identical, are the ripple counter 420 which provides a digital count to be stored to establish a value for each range cell; the operational amplifier 422 which operates as a threshold comparator; and the gain control setions 430–433 which fix the threshold of the comparator. Each time that the threshold on line 423 is exceeded by the analog output of the band pass amplifier 205 on line 424, then the counter 420 is stepped to the next higher value. The counter 420 is capable of a count of 16. For practical reasons the maximum count actually attained in this embodiment is 14. As each of the four output lines DB0–DB3 goes high, indicating a one in that digital position, one of the four gain control section gates 430, 431, 432 and 433 is opened. As each gate opens, the effective threshold established at comparator 422 is raised, so that a higher input must be received to again step the ripple counter 420**.

The four gain sections are designed to increment the threshold as follows: gate 430, controlled by DB0, raises the effective threshold 2db; gate 431, controlled by line DB1, raises the effective threshold 4db; gate 432, controlled by line DB2, raises the threshold 8db; gate 433, controlled by line DB3, raises the effective threshold 14db.

Gain gate section 430 is responsive to line DB0 to add the attenuator 454 to effectively reduce the signal input on line 424.

Gain gate sections 431 and 432 provide incremental increase in the threshold by changing the potential on input line 423. This change occurs by changing the effective resistance between point 450 (normally biased at about 1.6 volts by source 451 and potentiometer 452) and input 423. At the beginning of each counting sequence, because of the resistance between point 450 and input 423, this potential at point 450 has little effect on input 423. When the count reaches two, and line DB1 is high, then gate 431 is opened, shorting out the 11K and 15K resistors 455 and 456, and increasing the potential at input 423 to raise the threshold. When the count reaches four, and line DB2 is high, then gate 432 is opened and the 11K resistor 455 is shorted out substantially decreasing the resistance between point 450 and input 423, again increasing the voltage threshold at input 423. Thus, the gain for the first bit is changed just by switching on a small attenuator using gate 430 providing a 2db change. The next two bits of the counter switch threshold gates 431 and 432 and provide threshold increase of 4 and 8db respectively.

The gate section 433 controlled by line DB3 must provide a threshold increase of 14db. To provide this large change, an operational amplifier 460 is provided in the signal input path. Gate 433 substantially changes the feed back to this amplifier 460, and reduces the signal strength at the output 461 of amplifier 460.

Although a count of 16 in ripple counter 420 is possible, the limited number of threshold changes available within design limitations requires that the highest count be 14. Thus, when the three highest level output lines DB1, DB2, DB3 of the ripple counter 420 have gone high, then a count of 14 is indicated and the NAND gate 455 provides the signal DFULL to the D type flip-flop 460. This signal, applied to the marked input, places a Hold D signal on the line 462 running to the HOLD input of the counter 420. This causes the counter to hold its count, so that the counter may be read at the next interrupt. In the event that the counter does not reach its maximum count by the next interrupt, then the interrupt signal CLK64 holds the count while the counter is read.

The means 230 for transferring the data count stored in counter 420D into processor 199 via PIA 200, in addition to flip-flop 460 comprise multiplexer 470. It can be seen that the four outputs DB0, DB1, DB2 and DB3 from counter 420D all run to the four-bit data multiplexer 470 which has output lines RDAT0, 1, 2 and PAAB1 running to PIA 200. With each interrupt defined by CLK64 the instantaneous count is held and read via the data multiplexer 470 to measure at that range all of the direct or cross data fields and to store them in random access memory 200. The signals CROSS and CROSS* from the PIA 200 define which counter **420*c*, 420*d* shall be read by multiplexer 470. After both counters 420*d* and 420*c* are read, then the signal ADVANL is sent from the PIA 200 to the ripple counters reset line to clear the count in the counters 420*d*, 420*c*. The same signal runs to the D flip-flop 460 to clear the hold line of that flip-flop. Thus, the direct and cross data A/D converter sections are read alternately, the alternation being controlled by the signal CROSS which is alternately produced by the microprocessor and transmitted on via PIA 200 and line 480, shown in the lower left of the FIG. 10**.

It can be seen that this same signal CROSS is combined at gate 475 with the signal TSTAR which indicates that the analog signal return from a selected transducer is being processed, to produce a disable signal SHIN* to the select transducer preamplifier board decoder 198. This same signal TSTAR is also combined in an NAND gate 300 with the microprocessor produced signal ADVANL to generate the signal ADVAN which is sent to each transducer preamplifier board to step the stepping shift register 72 from one transducer to the next as the transducers are pulsed and read in succession. Thus, the signal TSTAR prevents the untimely generation of a signal SHIN selecting a new preamplifier board or a signal ADVAN stepping the selected board to shift register to enable a new transducer.

The output ports of the PIA 200 are not shown in detail; however, the allocation of the significant outputs is summarized as follows:

PIABO—the data output in time division multiplex format to the lane score processing unit.

PIA B2, PIA B3—do not sweep left/right alley; this control signal is transferred to the pinspotter chassis if only the 7 or 10 pin is down; these pins, when they fall alone on first ball, always fall of the lane bed, and sweeping is not necessary.

PIA B4, PIA B5—do not spot on left/right alley. This control signal orders the pin deck not to come down; this signal is sent in the event either a strike or a miss is detected.

PAB1, RDAT0, RDAT1, RDAT2—the four data input lines transferring direct and cross data from the A/D converter section 220 via multiplexer 230.

CLK 64—this is the regularly occurring timed interrupt signal. It is also used as a timed hold signal from the processor 199 via PIA 200 to the counters of the a/d converters 220. Specifically, the result is a setting of the hold lines from D-type flip-flop 460 to the ripple counters 420. The purpose is to hold the count in the counters 420 while it is read into the processor 199.

CROSS—a signal transmitted by the processor to indicate to the data multiplexer that the cross data rather than the direct data will now be read. It is also used as an enable signal in combination with the 3 Khz interrupt to allow the 2 of 4 decoder to move on to select a new preamplifier board.

ADVANl—a signal from the processor directed to the enabled preamplifier board to step from one enabled transducer to the next enabled transducer to be enabled. This signal is combined at gate 300 with the 3 Khz interrupt TSTAR to coordinate the transducer stepping sequence with interrupt timing and reading of the a/d converter 220 using multiplexer 230. The same signal also resets both counters of the a/d converter. This signal TSTAR remains high as long s the transducers of a selected preamplifier board are being read; it prevents the processor from moving on to another board.

LBANK, LALLEY—These two signals are developed by the microprocessor and transferred to the 2 to 4 decoder 198 to select one of the four preamplifier boards PR1–PR4, and thereby, one set of transducers.

The remaining parts of the PIA 200 are needed to address the random access memory 260 and read only memory 270; to accept data words from the addressed locations; and to transfer the data word representing pinfall to the lane score console (output line 290, FIG. 9).

A matter of concern in this system is to render it as maintenance free as possible. To this end, it is important that if the software fails to generate the pinfall data word, that it be instructed to scan the pin standing area and recompute the data word. Thus, means are provided to monitor the console communications line 290 and transmit a pulse ordering a program restart in the event of any failure. This software crash detection mechanism is shown in FIG. 11.

The PIA 200 (peripheral interface adapter) generates a width-modulated sequence of pulses which is amplified by amplifier 600, before it is transmitted to the scorer on line 290. This sequence of pulses is representative of the pinfall data detected by the pinsensor.

A monostable multivibrator 601 is set each time the voltage on the amplifier output goes positive; its output assumes a "1" level which when transmitted to one input of AND gate 602 by inventor 603 prevents clock pulses from clock source 240 from energizing the MPU restart line. Accordingly, as long as there is any signal activity on the communication line, the MPU restart line remains inactive. But as soon as the communication line 290 becomes inactive due to a system crash, the clock pulses activate this restart line and reset the system. This causes execution of the software at a predesignated location, i.e., the restart location, and this effects a sequence for recovering from a software crash.

I claim:

1. In a system for detecting and locating bowling pins standing in a defined area, the combination comprising:

a linear array of acoustic transducers, first selection means for selecting each one of said transducers for transmitting acoustic energy at a selected frequency toward said standing bowling pins, means for analyzing echo signals from said standing pins comprising:

analog-to-digital converter means for developing a digital representation of the magnitude of said acoustic reflections within a given period of time, and a microprocessor for accepting the output of said converter and analyzing said data to determine pin count and pin locations, and second selection means for causing the transfer of said echo signals from one or more of said transducers to said analyzing means.

2. A system as claimed in claim 1 wherein said converter means comprises a threshold device for comparing the magnitude of the acoustic echo signal with a defined effective threshold, means for defining an effective threshold and means for storing an indication that said acoustic echo signal has exceeded said defined threshold.

3. A system as claimed in claim 2 wherein said threshold comparing device comprises means for raising said defined threshold incrementally when said reflected signal exceeds the defined threshold.

4. A system as claimed in claim 3 wherein said storage means comprises a counter, having an input tripped by said threshold comparing device and an output running to said threshold device to change said defined threshold in response to each change in the count stored in said counter.

5. A system as claimed in claim 4 wherein said counter is a binary counter with a plurality of outputs representing the state of the accumulated count, said threshold comparator device comprising a plurality of gate controlled level setting devices for modifying the effective threshold level of said converter with each change in the binary count stored in said counter.

6. A system as claimed in claim 5 wherein said gate controlled level setting devices are arranged to provide a linear increase in the threshold level for said comparator for each change in the count in said counter.

7. A system as claimed in claim 6 wherein said binary counter has a capacity of at least three bits.

8. A system as claimed in claim 7 wherein said binary counter has an indicated capacity of four bits.

9. A system as claimed in claim 5 wherein said threshold comparator device comprises a two-input differential amplifier, means for applying said acoustic echo signal to one of said inputs, means for establishing a voltage level at the other of said inputs to define said effective threshold, said gate controlled level setting devices changing the voltage level at at least one of said inputs in response to each change of the count in said binary counter.

10. A system as claimed in claim 9 wherein said gate controlled devices comprise gain gate means for attenuating the reflected transducer signals comprising said acoustic echo signal return, and threshold gate means for raising the voltage threshold level in said comparator, said gain and threshold gate means being individually responsive to said counter outputs to provide a step-by-step exponential increase in the acoustic echo signal return magnitude needed to step up said counter.

11. A system as claimed in claim 10 wherein said counter has four significant outputs, said gain gate means being rsponsive to the least and most significant outputs of said counter, said threshold gate means being responsive to the second and third most significant outputs of said counter.

12. A system as claimed in claim 11 wherein said gain gate means comprises only two gates, each of said gates being controlled by one of said counter output lines, said threshold gate means comprising only two gates, each of said threshold gates being controlled by one of said counter output lines.

13. A system as claimed in claim 5 wherein said analyzing means includes interrupt means for holding the count in said binary counter while said count is read by said microprocessor and for resetting said counter after said reading.

14. A system as claimed in claim 13 wherein said interrupt means comprises means for indicating that a maximum counter has been reached by said counter, and a bistable device for holding the count in said binary counter in response to said indicating means or a signal from said microprocessor.

15. A system as claimed in claim 1 wherein said first and second selection means comprise:

first gate means for applying driving pulses to a selected one of the transducers, second gate means for transferring said acoustic reflection signals from said standing pins to said analyzing means, and transducer selection means for selecting one of said first gate means to transmit acoustic energy, and for selecting at least one of said second gate means for transferring the acoustic reflection signals to said analyzing means.

16. A system as claimed in claim 15 wherein said transducer selection means associated with said transducer array comprises a shift register having a plurality of outputs, a single one of said outputs running to the portions of said first and second gate means associated with each of said transducers.

17. A system as claimed in claim 16 wherein said shift register has two inputs from said microprocessor, said first input enabling said shift register to select among any one of said transducers, and said second input causing said shift register to select over one of said output lines a single one of said transducers.

18. A system as claimed in claim 1 including means for monitoring a pulse width modulated data output of said microprocessor, said output being updated at a fixed interrupt rate, comprising:

pulse output means triggered by each updating of data on said communication line, a source of clock pulses at said interrupt rate, and means comprising an AND-gate responsive to said clock source and the pulse output means to provide a restart command signal to said microprocessor only in the event of a stoppage in said pulse width modulated output.

* * * * *